US007742708B2

(12) United States Patent
Fukusada

(10) Patent No.: US 7,742,708 B2
(45) Date of Patent: Jun. 22, 2010

(54) IMAGE FORMING DEVICE AND CARTRIDGE IN WHICH AN AMOUNT OF DEVELOPER IS DETECTABLE

(75) Inventor: Yuki Fukusada, Aichi (JP)

(73) Assignee: Brother Kogyo Kabushiki Kaisha, Nagoyo-shi, Aichi-ken (JP)

( * ) Notice: Subject to any disclaimer, the term of this patent is extended or adjusted under 35 U.S.C. 154(b) by 0 days.

(21) Appl. No.: 12/155,956

(22) Filed: Jun. 12, 2008

(65) Prior Publication Data

US 2008/0317480 A1 Dec. 25, 2008

(30) Foreign Application Priority Data

Jun. 25, 2007 (JP) ..... 2007-166758

(51) Int. Cl.
*G03G 15/00* (2006.01)

(52) U.S. Cl. ..... 399/12; 399/13; 399/24; 399/35; 399/120

(58) Field of Classification Search ..... 399/12, 399/13, 24, 25, 27–30, 35, 107, 119, 120
See application file for complete search history.

(56) References Cited

U.S. PATENT DOCUMENTS 5,715,512 A * 2/1998 Kumagai ..... 399/349
5,923,918 A * 7/1999 Nakagawa et al. ..... 399/27
6,157,792 A * 12/2000 Mori et al. ..... 399/24
6,229,967 B1 * 5/2001 Miya et al. ..... 399/12
7,373,092 B2 * 5/2008 Tawada ..... 399/35
2004/0190918 A1 * 9/2004 Park ..... 399/35
2007/0122165 A1 * 5/2007 Igarashi et al. ..... 399/12

FOREIGN PATENT DOCUMENTS

JP 09-190136 7/1997
JP 2002-139971 5/2002
JP 2003-345203 12/2003

* cited by examiner

*Primary Examiner*—David M Gray
*Assistant Examiner*—Bamabas T Fekete
(74) *Attorney, Agent, or Firm*—Banner & Witcoff, Ltd.

(57) ABSTRACT

An image forming device includes a device body, a cartridge detachably attached to the device body so as to accommodate material which includes one of consumable material and waste material, a sensor configured to emit and receive sensing light and give a detection value corresponding to an amount of the material in the cartridge which amount is detected based upon an intensity of the sensing light received thereby, a received light changing member configured to change the intensity of the sensing light received by the sensor, and a judging unit configured to judge based upon a change of the detection value given by the sensor whether the cartridge is a new one.

14 Claims, 9 Drawing Sheets

IMAGE FORMING DEVICE AND CARTRIDGE IN WHICH AN AMOUNT OF DEVELOPER IS DETECTABLE

CROSS-REFERENCE TO RELATED APPLICATION

This application claims priority under 35 U.S.C. §119 from Japanese Patent Application No. 2007-166758 filed on Jun. 25, 2007. The entire subject matter of the application is incorporated herein by reference.

BACKGROUND

1. Technical Field

The following description relates to one or more image forming devices and cartridges detachably attached thereto.

2. Related Art

Conventionally, for an image forming device provided with a waste toner box for collecting therein waste material generated in an image forming operation, there has been known a technique to optically check whether an amount of the waste material in the waste toner box reaches a predetermined value (for example, see Japanese Patent Provisional Publication No. 2002-139971). In addition, there has been known as a technique similar to the above technique, a technique to optically detect an amount of toner left in a toner cartridge.

Before the waste toner box is filled with the waste material, or the toner cartridge is vacant, the above techniques can notify a user that the waste toner box or toner cartridge (hereinafter referred to as a cartridge) is replaced with a new one, and induce the user to replace the cartridge with a new one. When the cartridge is replaced with a new one, there are executed initializing operations such as initializing of a counter for counting the number of printed papers (which counter is provided to estimate a usage history of the cartridge) and abort of a display for inducing the user to replace the cartridge with a new one.

SUMMARY

However, in the conventional techniques, since there is generally provided a sensing means dedicated to detecting a new cartridge with which an old one is replaced, it results in a complicated structure and a higher cost of the image forming device.

To solve the above problems, the image forming device can be configured to detect the amount of the material in the cartridge with an existing sensor and judge that the cartridge is replaced with a new one when the detected amount varies in an opposite tendency from a normal tendency. Thereby, a sensor dedicated to the detection of a new cartridge can be saved. However, in the method to detect a new cartridge by estimating the amount of the material in the cartridge with the sensor, a wrong detection result might accidentally be provided for any reason. For example, the material in the cartridge sometimes accumulates in a partial area Therefore, such an accumulating way of the material in the cartridge might cause a wrong detection result, and thus it is impossible to perform a highly reliable detection.

Aspects of the present invention are advantageous in that there are provided one or more improved image forming devices and cartridges that make it possible to detect a new cartridge using an existing sensor in a highly reliable manner.

According to aspects of the present invention, there is provided an image forming device, which includes a device body, a cartridge detachably attached to the device body so as to accommodate material which includes one of consumable material and waste material, a sensor configured to emit and receive sensing light and give a detection value corresponding to an amount of the material in the cartridge which amount is detected based upon an intensity of the sensing light received thereby, a received light changing member configured to change the intensity of the sensing light received by the sensor, and a judging unit configured to judge based upon a change of the detection value given by the sensor whether the cartridge is a new one.

In some aspects of the present invention, when a new cartridge is used, the intensity of the sensing light received by the sensor is changed by the received light changing member. Then, the judging unit judges based upon a change of the detection value given by the sensor whether the cartridge is a new one. More specifically, when the change of the detection value given by the sensor corresponds to the change of the intensity of the sensing light received by the sensor, it is judged that the cartridge is a new one. Thus, according to the aforementioned configuration, since the judgment on whether the cartridge is a new one is made with an existing sensor for detecting the amount of the material in the cartridge, the configuration can be simplified. Further, the judgment on whether the cartridge is a new one is made by checking the change of the detection value given by the sensor for the intensity of the sensing light received by the sensor which intensity is modulated by the received light changing member. Therefore, highly reliable detection of a new cartridge can be performed.

According to another aspect of the present invention, there is provided a cartridge configured to detachably attached to an image forming device, which cartridge includes a space configured to accommodate material which includes one of consumable material and waste material, and a received light changing member configured to be non-recursively moved from an initial state to a final state so as to change an intensity of sensing light for detecting an amount of the material in the space in a non-recursive movement thereof from the initial state to the final state.

According to the cartridge configured as above, the same effects as the aforementioned image forming device can be provided. Furthermore, since the received light changing member is non-recursively moved from the initial state to the final state, it is possible to attain further reliable detection of a new cartridge.

BRIEF DESCRIPTION OF THE ACCOMPANYING DRAWINGS

FIGS. 5A to 5E schematically show movement of a light-shielding tape in a new cartridge detecting process in the first embodiment according to one or more aspects of the present invention.

Figure 6:
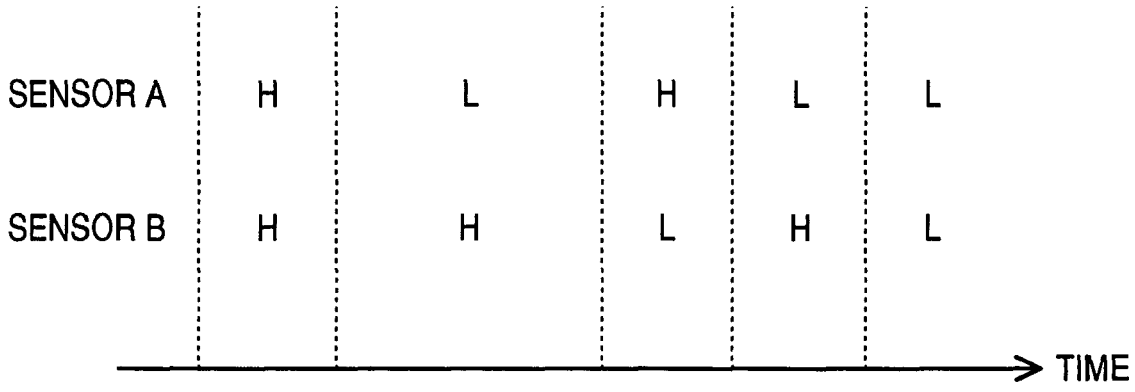

FIG. 6 shows relationship between time and detection values of sensors A and B in the first embodiment according to one or more aspects of the present invention.

Figure 7:
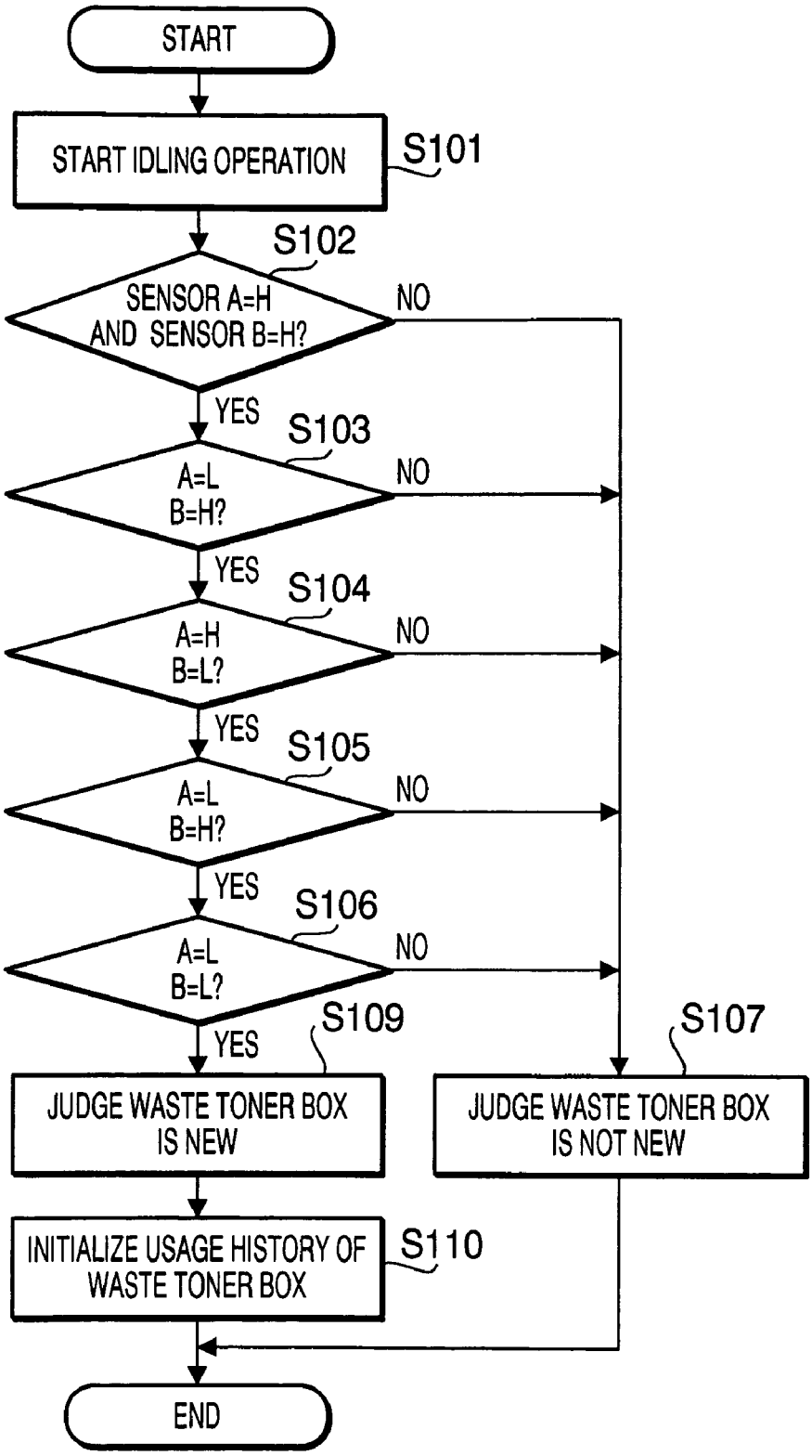

FIG. 7 is a flowchart showing a procedure of the new cartridge detecting process in the first embodiment according to one or more aspects of the present invention.

Figure 8:
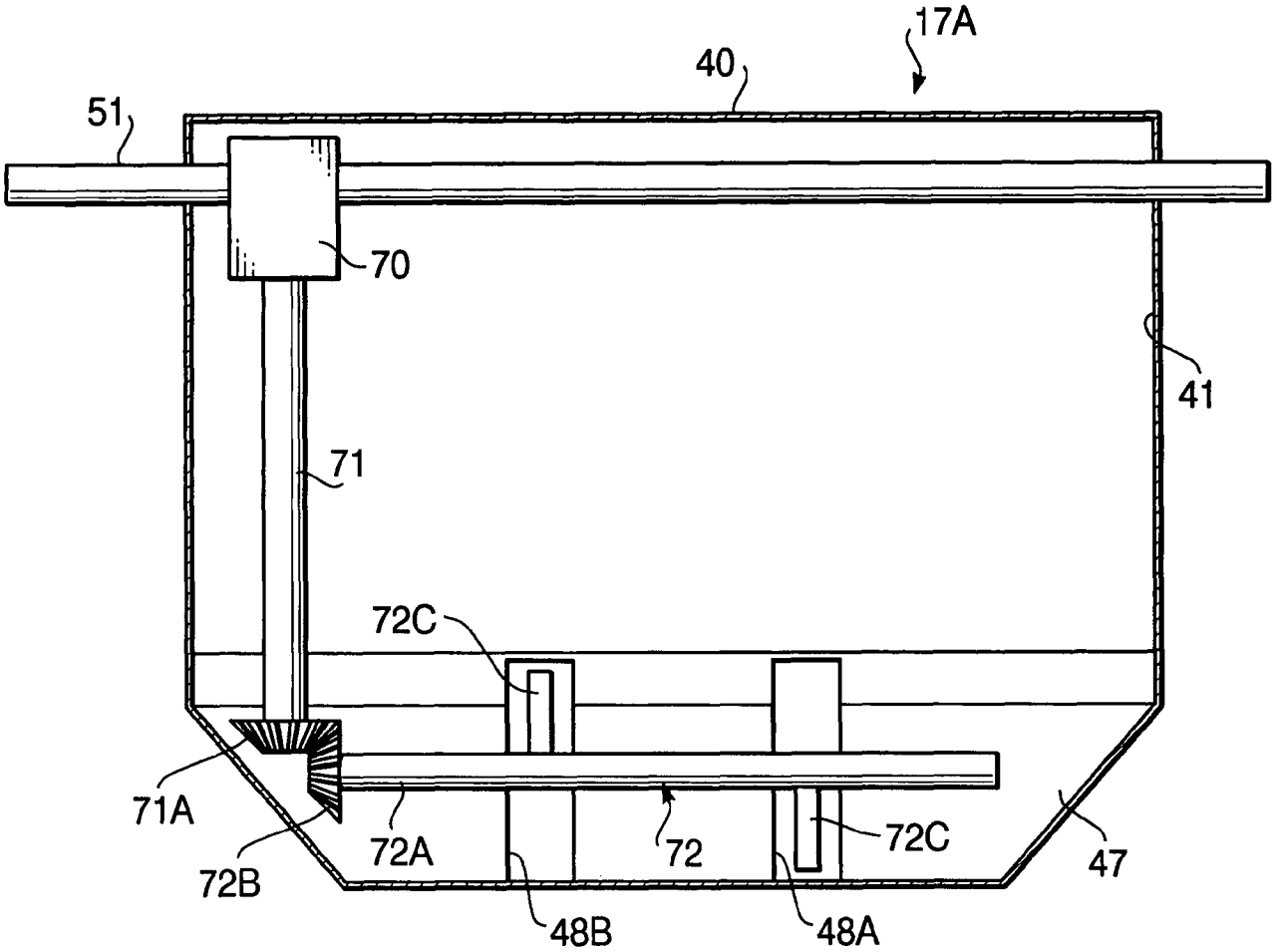

FIG. 8 is a cross-sectional top view of a waste toner box in a second embodiment according to one or more aspects of the present invention.

Figure 9:
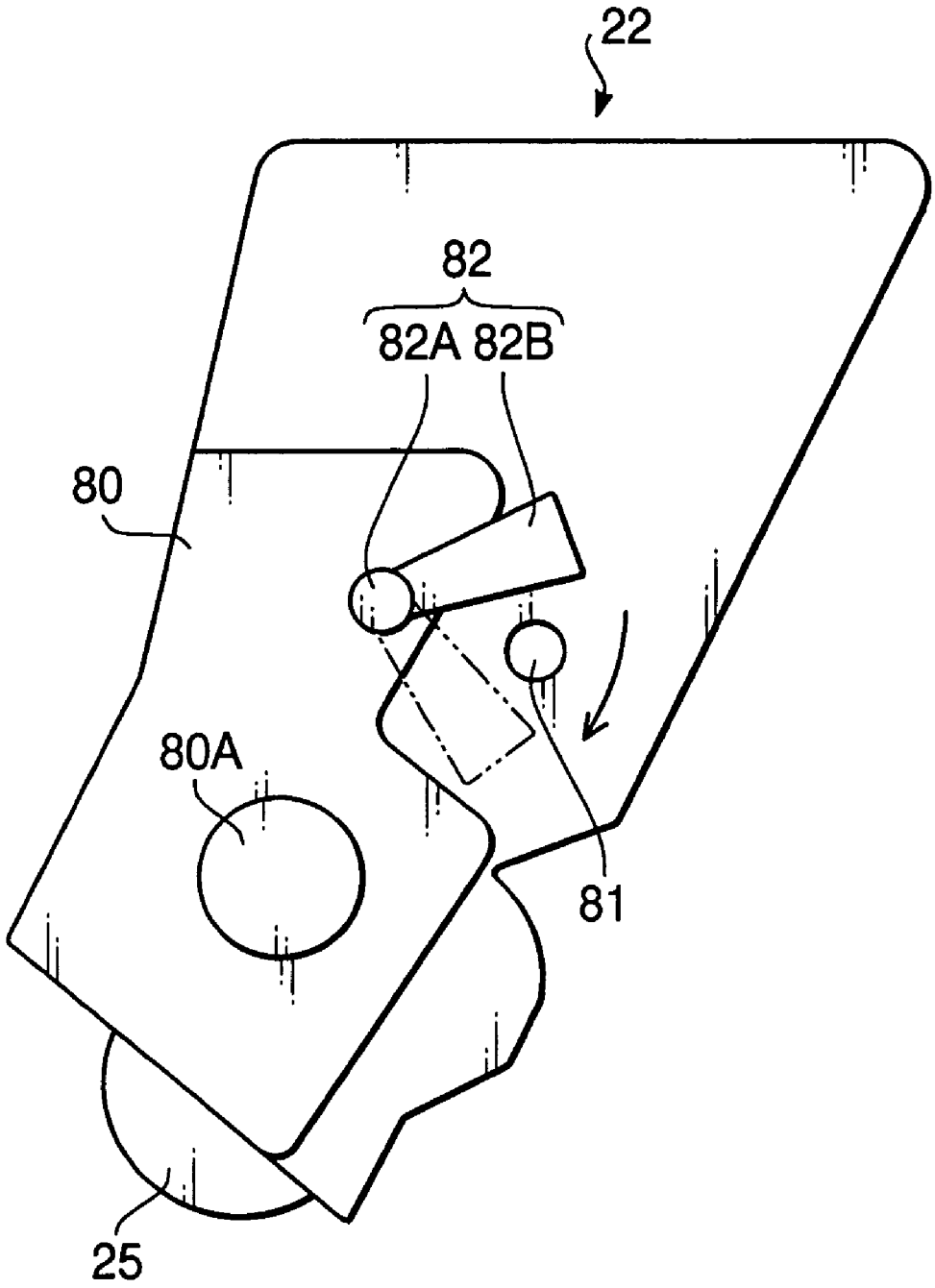

FIG. 9 is a side view of a toner cartridge in a third embodiment according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the invention may be implemented in computer software as programs storable on computer-readable media including but not limited to RAMs, ROMs, flash memory, EEPROMs, CD-media, DVD-media, temporary storage, hard disk drives, floppy drives, permanent storage, and the like.

First Embodiment

Hereinafter, a first embodiment according to aspects of the invention will be described with reference to FIGS. 1 to 7.

(Entire Configuration of Printer)

Figure 1:
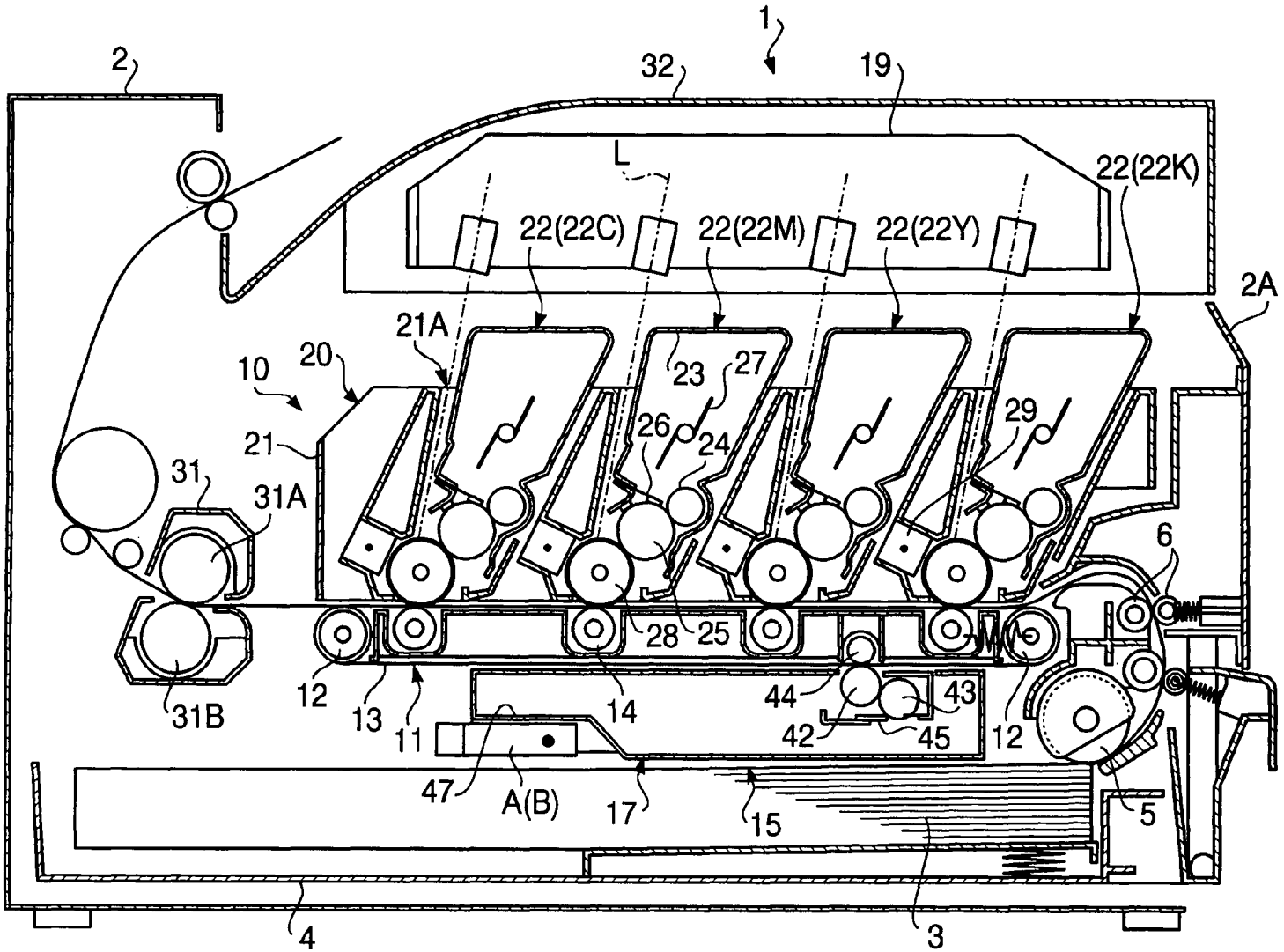
FIG. 1 is a cross-sectional side view schematically showing a configuration of a printer as an example of an image forming device in a first embodiment according to one or more aspects of the present invention.

FIG. 1 is a cross-sectional side view schematically showing a printer 1 as an example of an image forming device according to aspects of the present invention. It is noted that a right side of FIG. 1 will be defined as a front side of the device in the following description.

The printer 1 includes a casing 2, and there is provided at a bottom side of the casing 2 a paper feed tray 4 in which papers 3 as recording media are placed. A paper feed roller 5 is provided at an upper front side of the paper feed tray 4. Along with rotation of the paper feed roller 5, a top one of the papers 3 in the paper feed tray 4 is carried to a registration roller 6. The registration roller 6 conveys the paper 3 onto a belt unit 11 of an image forming unit 10 after skew correction for the paper 3.

The image forming unit 10 includes the belt unit 11, a scanner unit 19, a process unit 20, and a fixing unit 31.

The belt unit 11 is configured with a belt 13 made of polycarbonate wound around a pair of belt supporting rollers 12. With a belt supporting roller 12 at a rear side being rotated, the belt 13 is revolved in a counterclockwise direction in FIG. 1, and the paper 3 on the belt 13 is conveyed backward. In addition, there are provided inside the belt 13 wound around the belt supporting rollers 12, transcriptional rollers 14 so as to face respective photoconductive drums 28 of the below-mentioned process unit 20 through the belt 13. Further, there is provided under the belt unit 11, a box attachment portion 15, to which a waste toner box 17 configured to collect and accommodate toner and paper powder dust adhered onto the belt 13 is detachably attached. It is noted that the waste toner box 17 will be described later in detail.

The scanner unit 19 is configured to make a laser beam emitted by a laser emitting element (not shown) for each color incident onto a corresponding one of the photoconductive drums 28.

The process unit 20 includes a frame 21 that can be drawn forward by opening a front cover 2A provided at the front side of the casing 2, toner cartridges 22 (22K, 22Y, 22M, and 22C) corresponding to respective four colors (Black, Yellow, Magenta, and Cyan) which toner cartridges 22 are detachably attached to respective four cartridge attachment portions 21 A provided to the frame 21. Further, there are provided at a lower side of the frame 21, for the respective toner cartridges 22, the photoconductive drums 28 each of which has a surface covered with a photoconductive layer to be positively charged and scorotron-type electrification control devices 29.

Each of the toner cartridges 22 is provided with a toner container 23 that accommodates corresponding colored toner as developer, and further includes a supply roller 24, development roller 25, layer thickness regulating blade 26, and agitator 27 at a lower side of the toner container 23. The toner in the toner container 23 is supplied to the development roller 25 through the rotation of the supply roller 24, and positively charged in a frictional manner between the supply roller 24 and development roller 25. Further, the toner supplied onto the development roller 25 is conveyed between the layer thickness regulating blade 26 and development roller 25 along with the rotation of the development roller 25, and further sufficiently charged in a frictional manner to be held on the development roller 25 as a thin layer with a predetermined constant thickness.

In an operation of forming an image, along with the rotation of the photoconductive drum 28 driven, the surface of the photoconductive drum 28 is evenly and positively charged by the electrification control device 29. Then, the positively charged surface is exposed to a high speed scanning laser beam emitted by the scanner unit 19, and an electrostatic latent image corresponding to an image to be formed on the paper 3 is formed on the photoconductive drum 28.

Next, the positively charged toner held on the development roller 25 is supplied to the electrostatic latent image formed on the surface of the photoconductive drum 28, when coming to face and contact the photoconductive drum 28 with the rotation of the development roller 25. Thereby, the toner is adhered only to an exposed portion on the surface of the photoconductive drum 28 such that the electrostatic latent image on the photoconductive drum 28 can visually be recognized.

Thereafter, the toner image held on the surface of each of the photoconductive drums 28 is sequentially transferred onto the paper 3 by a negative transcriptional voltage applied to each of the transcriptional rollers 14, while the paper 3 conveyed by the belt 13 passes through transcriptional positions between the photoconductive drums 28 and transcriptional rollers 14. Thus, the paper 3 with the toner image transferred thereon is subsequently conveyed to the fixing unit 31.

The fixing unit 31 is configured with a heating roller 31A including a heat sources pressing roller 31B that presses the paper 3 toward the heating roller 31A to thermally fix the toner image transferred onto the paper 3. The paper 3 with the toner image thermally fixed thereon is conveyed upward and discharged onto a catch tray 32 provided on an upper face of the casing 2.

(Structure of Waste Toner Box)

Figure 2:
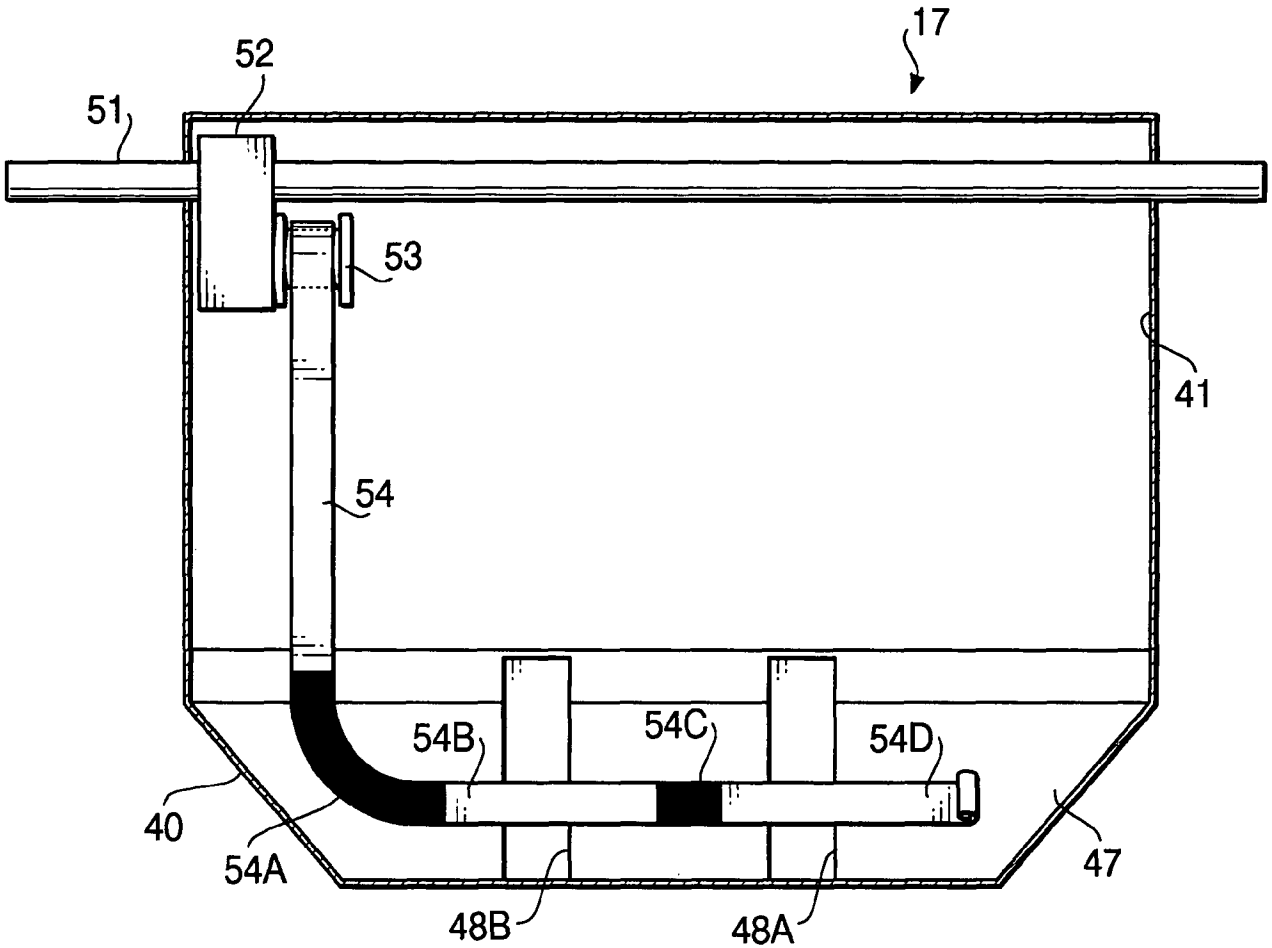
FIG. 2 is a schematic cross-sectional top view of a waste toner box in the first embodiment according to one or more aspects of the present invention.
Figure 3:
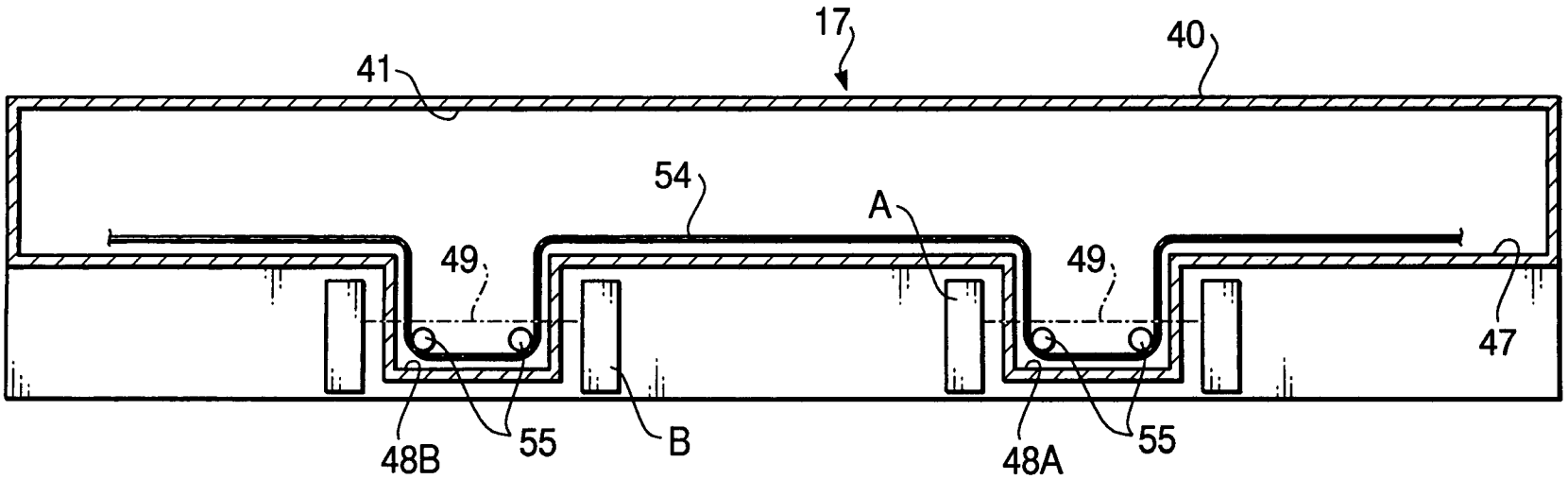
FIG. 3 is a schematic cross-sectional back view of the waste toner box in the first embodiment according to one or more aspects of the present invention.

FIG. 2 is a schematic cross-sectional top view of the waste toner box 17. FIG. 3 is a schematic cross-sectional back view of the waste toner box 17.

The waste toner box 17 is configured to be attached to and detached from the casing 2 in a state where a front cover 2A of the casing 2 is opened, and the process unit 20 and belt unit 11 are taken out through the opening of the casing 2. The waste toner box 17 is provided with a case 40 formed in a flat box shape, and a container 41 to accommodate toner collected.

At an upper front portion in the case 40, as shown in FIG. 1, there are rotatably provided a cleaning roller 42 and collecting roller 43 so as to establish pressure-contact with each other. The cleaning roller 42 is configured with a form material formed around a metal shaft member, so as to face a metal back-up roller 44 provided in the belt unit 11 through the belt 13. The cleaning roller 42 is driven, by a power transmitted from a main motor 67 (see FIG. 4) provided at the casing 2 side, in an opposite direction from a conveyed direction of the belt 13. Further, since a predetermined bias voltage is applied to between the cleaning roller 42 and back-up roller 44, the toner (and the like) adhered onto the belt 13 is physically removed and electrically attracted toward the cleaning roller 42 side.

The collecting roller 43, made of metal, is configured to attract the toner and the like adhered onto the cleaning roller 42 with a predetermined bias voltage being applied to between the collecting roller 43 and the cleaning roller 42. Further, beneath the collecting roller 43, a rubber scratching blade 45 is provided to establish pressure-contact with the collecting roller 43. Thereby, the toner adhered onto a surface of the collecting roller 43 is scratched off by the scratching blade 45 and accumulated into the container 41.

A bottom wall of a rear portion of the case 40 is formed from a transparent resin material. In addition, at the rear portion of the case 40, there is formed a step 47 one level higher than a front portion of the case 40. As shown in FIGS. 2 and 3, the step 47 includes a pair of groove portions 48A and 48B respectively provided at right and left sides to be open upward and extend in a front-to-rear direction.

Meanwhile, in the casing 2, there are provided a sensor A and sensor B each of which includes a light emitting element and light receiving element disposed in a right-to-left direction so as to face each other through each of the groove portions 48A and 48B. Each of the sensors A and B is configured such that sensing light emitted from the light emitting element to the light receiving element is transmitted through side walls of each of the groove portions 48A and 48B and passes across each of the groove portions 48A and 48B. The light receiving element of each of the sensors A and B is configured to issue an output signal depending on an intensity of the light received thereby.

The waste toner box 17 is, as shown in FIG. 2, provided with a shaft body 51 rotated by a power transmitted from the main motor 67. The shaft body 51 is joined with a take-up roller 53 for rewinding a light shielding tape 54 via a gear mechanism in a gear box 52. It is noted that the gear mechanism connecting the shaft body 51 with the take-up roller 53 incorporates a tooth-chipped gear such that power transmission to the take-up roller 53 is broken in the case where the shaft body 51 is rotated at a predetermined angle from an initial state.

The light-shielding tape 54 is formed from synthetic resin to be a thin flexible belt, and placed such that a portion at one end side thereof crosses over the step 47. In addition, a portion of the light-shielding tape 54, which droops into each of the groove portions 48A and 48B, is guided by the guides 55 to shield the optical path of each of the sensors A and B. Further, the other end portion of the light-shielding tape 54 is attached to the take-up roller 53. When the shaft body 51 is driven and the take-up roller 53 is rotated, the light-shielding tape 54 is wound around the take-up roller 53, and non-recursively shifted from an initial state to a final state as will be described below. The light-shielding tape 54 is provided with transparent portions 54B and 54D through which the light emitted by the sensors A and B is transmitted and black portions 54A and 54C that block the light. The transparent portions 54B and 54D and black portions 54A and 54C are alternately formed in a longitudinal direction as a predetermined pattern used in a below-mentioned new cartridge detecting process.

(Electrical Configuration of Printer)

Figure 4:
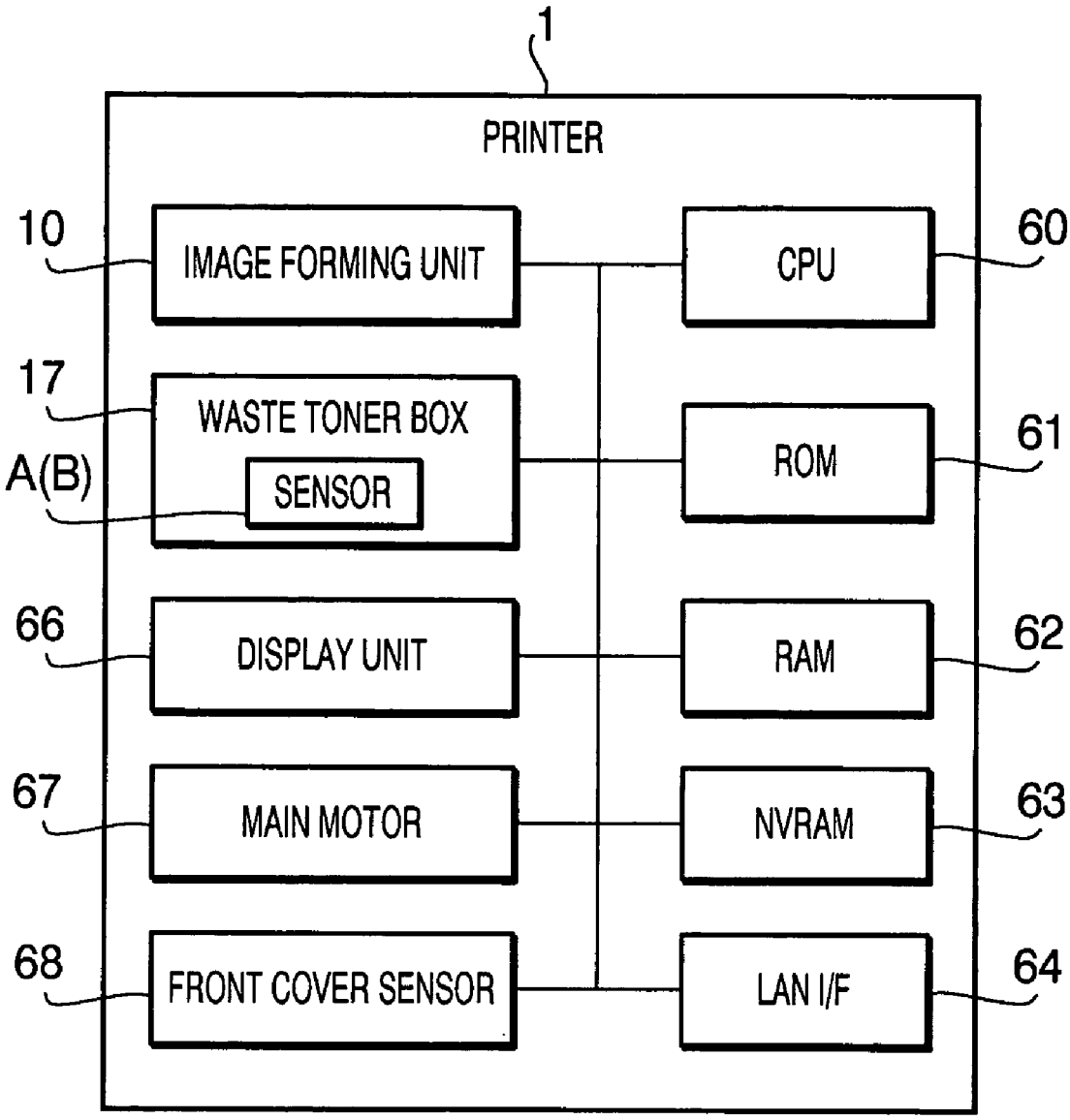
FIG. 4 is a block diagram schematically showing an electrical configuration of the printer in the first embodiment according to one or more aspects of the present invention.

FIG. 4 is a block diagram schematically showing an electrical configuration of the printer 1. The printer 1 is, as shown in FIG. 4, provided with a CPU 60, ROM 61, RAM 62, NVRAM (non-volatile memory) 63, and network interface 64, which are further connected with a display unit 66, main motor 67, front cover sensor 68, the aforementioned image forming unit 10, and the sensors A and B of the waste toner box 17.

There are stored on the ROM 61, programs for executing various operations of the printer 1. The CPU 60 controls each element of the printer 1 in accordance with programs read out from the ROM 61, storing process results on the RAM 62 or NVRAM 63. Further, the CPU 60 stores on the NVRAM 63 a numerical value (count) representing a usage history of the waste toner box 17 (e.g., the number of papers printed since the replacement of the new waste toner box 17).

The network interface 64 is connected with an external computer via a communication cable (not shown), and thereby mutual data communication can be achieved. The display unit 66 is configured with an LCD display or a lamp to display thereon various setting screen images and operating statuses. The main motor 67 synchronously rotates the aforementioned registration rollers 6, belt supporting rollers 12, development rollers 25, photoconductive drums 28, heating rollers 31A, cleaning roller 42, and shaft body 51. The front cover sensor 68 outputs a signal denoting whether the front cover 2A is opened or not.

(New Box Detecting Process)

Subsequently, the new cartridge detecting process to be executed under control of the CPU 60 will be described. FIG. 5 schematically shows movement of the light-shielding tape in the new cartridge detecting process. FIG. 6 shows the relationship between time and detection values of the sensors A and B. FIG. 7 is a flowchart showing a procedure of the new cartridge detecting process.

The CPU 60 compares the output signals of the sensors A and B with a predetermined threshold to acquire digitized data of H (ON) and L (OFF). When both the detection values by the sensors A and B are H in a normal operation (other than the below-mentioned new cartridge detecting process), the CPU 60 shows, on the display unit 66, a life end display for inducing a user to replace the waste toner box 17 with a new one based on judgment that the amount of the toner in the waste toner box 17 reaches a predetermined value. Thereafter, when the front cover sensor 68 detects that the front cover 2A is once opened and thereafter closed, the new cartridge detecting process is executed to judge whether the waste toner box 17 is replaced with a new one.

Figure 5A:
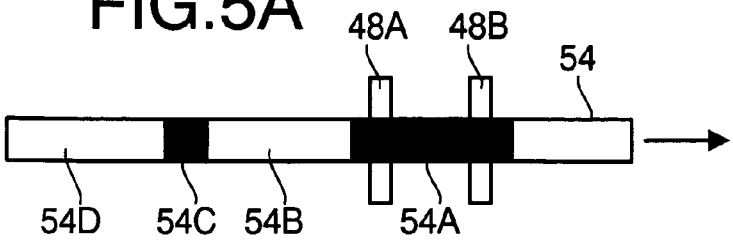
Figure 5B:
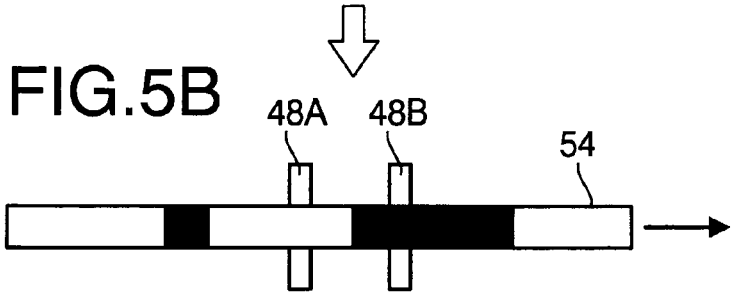
Figure 5C:
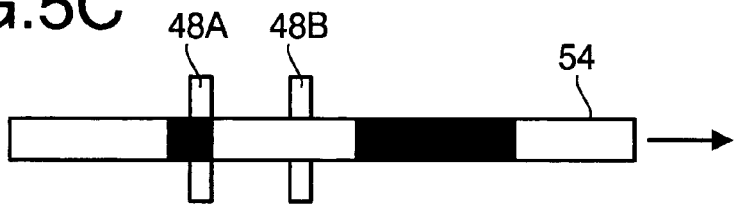
Figure 5D:
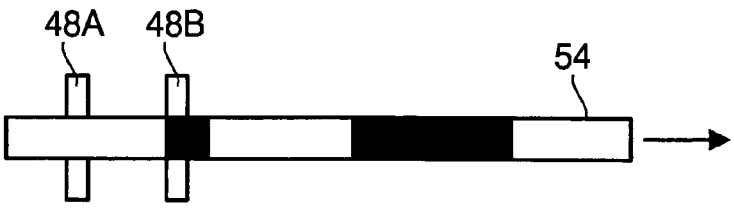
Figure 5E:
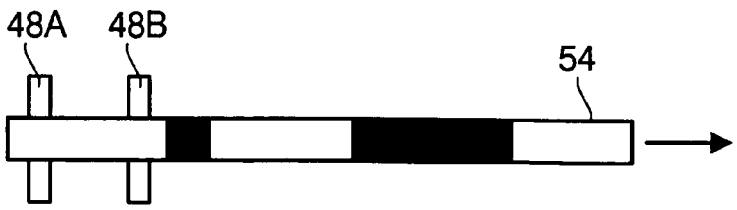

In the meantime, immediately after a new waste toner box 17 is attached to the printer 1, the light-shielding tape 54 is in an initial state shown in FIG. 5A. In the initial state, the black portion 54A is located in both the groove portions 48A and 48B, and the sensors A and B concurrently give the value H representing a light shielded state. Then, when the light-shielding tape 54 is shifted in the longitudinal direction, the sensor A gives the value L while the sensor B gives the value H (see FIG. 5B). Subsequently, the sensor A shows the value H, and the sensor B shows the value L (see FIG. 5C). Thereafter, the sensor A gives the value L, and the sensor B gives the value H (see FIG. 5D). When the light-shielding tape 54 is shifted up to a final state shown in FIG. 5E, the sensors A and B concurrently show the value L.

After booting the new cartridge detecting process, the CPU 60 firstly starts an idling operation in which the main motor 67 is driven during a predetermined period (S101). When a new waste toner box 17 is attached in the casing 2 in the idling operation, as described above, the take-up roller 53 is rotated via the shaft body 51, and the light-shielding tape 54 is rewound around the take-up roller 53.

The CPU 60 examines the change of the detection values of the sensors A and B in the idling operation as follows. The CPU 60 judges whether the sensors A and B concurrently give the value H (S102). When it is judged that the sensors A and B concurrently give the value H (S102: Yes), the CPU judges whether the sensor A gives the value L and the sensor B gives the value H within a predetermined period (S103). Further, the CPU sequentially judges whether the sensor A gives the value H and the sensor B gives the value L within a predetermined period (S104), whether the sensor A gives the value L and the sensor B gives the value H within a predetermined period (S105), and finally whether the sensors A and B concurrently give the value L within a predetermined period (S106).

When the judgment is negative in any one of the aforementioned steps S102 to S106 (any one of S102-S106: No), it is judged that the waste toner box 17 attached in the casing 2 has not yet been replaced with a new one (S107). When the judgment is affirmative in each of the aforementioned steps S102 to S 106 (S102-S106: Yes), it is judged that the waste toner box 17 attached in the casing 2 has been replaced with a new one (S109). Then, the numerical value representing the usage history of the waste toner box 17 that is stored on the NVRAM 63 is initialized to be zero (S110).

(Effects Provided in First Embodiment)

As described above, according to the present embodiment, when a new waste toner box 17 is used, the intensities of the light received by the sensors A and B vary depending on the distance of the light-shielding tape 54 shifted from the initial state to the final state. Therefore, when changes of the detection values by the sensors A and B correspond to the variation of the light intensities depending on the shift amount of the light-shielding tape 54, the waste toner box 17 is judged to be a new one. In the present embodiment, since it is judged, by using the sensors A and B for detecting the toner amount, whether the waste toner box 17 is a new one, the configuration of the waste toner box 17 can be simplified. In addition, the light-shielding tape 54 is non-recursively shifted from the initial state to the final state so that highly reliable detection can be attained.

Further, since the judgment whether the waste toner box 17 is a new one is made based on not only the detection values of the sensors A and B but also the time change of the detection values thereof, the accuracy of the judgment can be more improved.

Further, since a plurality of sensors A and B are employed for the judgment, the reliability of the judgment can be more improved.

Further, the light-shielding tape 54 is configured to change the intensities of the light received by the sensors A and B such that the detection values of the sensors A and B are different from each other. It is less likely to be caused that detection values by a plurality of sensors are different from each other in a general configuration. Thus, the reliability of the judgment can be further improved owing to the different detection values by the sensors A and B.

Further, the light-shielding tape 54 is configured to reverse the detection values of the sensors A and B to be different from each other, and the waste toner box 17 is judged to be a new one under a condition that the detection values by the sensors A and B are reversed to be different from each other. Thus, the reliability of the judgment can be further improved, since it is much less likely to be caused that detection values by part of a plurality of sensors and the other sensors are reversed to be different from each other in a general configuration.

Additionally, by storing the numerical value representing the usage history of the waste toner box 17 (e.g., the number of papers printed since the replacement of the new waste toner box 17) the timing when the waste toner box 17 is to be replaced with a new one can be shown based on the numerical value.

Second Embodiment

FIG. 8 is a cross-sectional top view of a waste toner box 17A in a second embodiment. It is noted that, in the following description, an element configured in the same manner as the first embodiment will be denoted by the same reference character, and explanation thereof will be omitted.

The shaft body 51 of the waste toner box 17A is linked with a joint member 71 via a gear mechanism in a gear box 70, and the joint member 71 is linked with a light-shielding member 72 via a gear portion 71A provided at an end of the joint member 71. It is noted that the gear mechanism connecting the shaft body 51 with the joint member 71 incorporates a tooth-chipped gear such that power transmission to the joint member 71 is broken in the case where the shaft body 51 is rotated at a predetermined angle from an initial state.

The light-shielding member 72 is provided with a shaft portion 72A supported so as to cross over a pair of groove portions 48A and 48B formed on the step 47. An end of the shaft portion 72A is joined with the shaft member 71 via a gear portion 72B. In addition, on an outer circumferential surface of the shaft portion 72A, plate-shaped light-shielding portions 72C are formed in positions corresponding to the groove portions 48A and 48B so as to extend outward in a radial direction of the shaft portion 72A.

In the new cartridge detecting process, when a new waste toner box 17A is attached in the casing 2, the shaft body 51 is rotated along with the idling operation, and thereby the light-shielding member 72 is rotated via the joint member 71 from an initial state and stopped in a final state. While the light-shielding member 72 is rotated from the initial state to the final state, the light-shielding portions 72C block the optical paths of the sensors A and B at respective predetermined timings. The CPU 60 checks whether the detection values of the sensors A and B correspond to respective values thereof to be obtained by the light-shielding member 72 blocking the optical paths of the sensors A and B, and judges based on the check result whether the waste toner box 17A is a new one. It is noted that the second embodiment can provide the same effects as those in the first embodiment.

Third Embodiment

Subsequently, a third embodiment according to aspects of the present invention will be explained with reference to FIG. 9. FIG. 9 is a side view of the toner cartridge 22.

On a side face of the toner cartridge, there is provided a gear box 80 that accommodates a gear mechanism. The gear box 80 is provided with a joint portion 80A. A power, which is inputted from the main motor 67 through the joint portion 80A, is transmitted to the development rollers 25 and agitators 27 via the gear mechanism.

In addition, on each of a right side face and left side face of the toner cartridge 22, there is provided a remaining amount detection window 81. Meanwhile, in the casing 2, there is provided a remaining amount detection sensor (not shown) that includes a light emitting element disposed to face one of the remaining amount detection windows 81 and a light receiving element disposed to face the other remaining amount detection window 81. The remaining amount detection sensor is configured to have an optical path passing across the toner container 23 and to issue an output signal corresponding to an intensity of light received by the light receiving element.

The gear box 80 is further provided with a detection member 82 attached thereto. The detection member 82 includes a shaft portion 82A rotatably supported by the gear box 80, and a plate-shaped light-shielding portion 82B formed to extend from the shaft portion 82A. The shaft portion 82A of the detection member 82 and the gear mechanism in the gear box 80 are joined via a tooth-chipped gear. When the detection member 82 is rotated at a predetermined angle from an initial state, transmission of power to the detection member 82 is blocked.

The CPU 60 detects the amount of the toner remained in the container 41 based on the output signal of the remaining amount detection sensor. When detecting that the remaining toner amount is equal to or less than a predetermined value, the CPU shows, on the display unit 66, a display to induce the user to replace the toner cartridge 22 with a new one. Thereafter, when it is detected by the front cover sensor 68 that the front cover 2A is once opened and thereafter closed, there is executed a new cartridge detecting process for judging whether the toner cartridge 22 is replaced with a new one.

When it is judged in the new cartridge detecting process that a new toner cartridge 22 is attached in the casing 2, the detection member 82 is moved from the initial state and stopped in the final state along with the idling operation. While the detection member 82 is moved from the initial state to the final state, the light-shielding portion 82B blocks the optical path of the remaining amount detection sensor at a predetermined timing. The CPU 60 checks whether the detection value by the remaining amount detection sensor indicates a value corresponding to a state where the optical path of the remaining amount detection sensor is blocked by the detection member 82. Then, based on the check result, it is judged whether the toner cartridge 22 is a new one.

It is noted that, in the present embodiment, by storing a numerical value (count) regarding a usage history of the toner cartridge 22 (e.g., the number of papers printed after the replacement of the toner cartridge 22) onto the NVRAM 63, for example, it is possible to take control for changing a transcriptional bias voltage or development bias voltage depending on the numerical value.

Hereinabove, the embodiments according to aspects of the present invention have been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only exemplary embodiments of the present invention and but a few examples of its versatility are shown and described in the present disclosure. It is to be understood that the present invention is capable of use in various other combinations and environments and is capable of changes or modifications within the scope of the inventive concept as expressed herein.

Modifications

For example, following modifications are possible within such a scope as not to extend beyond the essential teachings of the present invention.

(1) Although one or two sensors are provided to detect the amount of contents in each cartridge in the aforementioned embodiments, three or more sensors may be provided.

(2) Although a configuration with a detection member blocking sensing light is shown in the aforementioned embodiments, there may be possible such a configuration that sensing light is reflected by a detection member toward a light receiving element to change an intensity of light received by the light receiving element. In addition, although digitized two values of H and L are employed as detection values of the sensor in the aforementioned embodiments, three or more values may be employed as detection values with such a configuration that a received light intensity of a sensor is changed by a detection member into three or more levels.

(3) The new cartridge detecting process may be executed when the image forming device is powered on, or each time a cover of the image forming device is moved from an opened state to a closed state.

What is claimed is:

1. An image forming device, comprising:

a device body;

a cartridge detachably attached to the device body so as to accommodate waste material;

a sensor configured to emit and receive sensing light across the cartridge and provide a detection value corresponding to an amount of the waste material in the cartridge which amount is detected based upon an intensity of the received sensing light;

a received light changing member configured to change the intensity of the sensing light received by the sensor regardless of the amount of the waste material in the cartridge; and a judging unit configured to judge based upon a change of the detection value provided by the sensor whether the cartridge is new regardless of the amount of the waste material in the cartridge.

2. The image forming device according to claim 1, wherein the received light changing member is configured to be non-recursively moved from an initial state to a final state so as to change the intensity of the sensing light received by the sensor in a non-recursive movement thereof from the initial state to the final state.

3. The image forming device according to claim 1, wherein the judging unit judges that the cartridge is new in a case where the sensor provides the detection value corresponding to a change in the intensity of the sensing light received by the sensor.

4. The image forming device according to claim 1, wherein the judging unit judges based upon a time change of the detection value provided by the sensor whether the cartridge is new.

5. The image forming device according to claim 1,
wherein the sensor includes a plurality of sensors, and
wherein the judging unit judges based upon the detection values provided by the plurality of sensors.

6. The image forming device according to claim 5,
wherein the judging unit acquires the detection value provided by each of the plurality of sensors as one of two values, and
wherein the received light changing member changes intensity of the sensing light received by each of the plurality of sensors such that a detection value provided by part of the plurality of sensors is different from a detection value provided by other of the plurality of sensors.

7. The image forming device according to claim 6,
wherein the received light changing member is belt-shaped with a pattern formed in a longitudinal direction thereof to change the intensity of the sensing light received by the sensor, and movable in the longitudinal direction.

8. The image forming device according to claim 1, further comprising;
an estimating unit configured to estimate a usage history of the cartridge as a numerical value; and
a storage unit configured to store the numerical value regarding the usage history of the cartridge,
wherein the judging unit initializes the numerical value when judging that the cartridge is new.

9. The image forming device according to claim 8, further comprising a display unit configured to display a notification when the numerical value regarding the usage history of the cartridge is more than a predetermined value.

10. The image forming device according to claim 1,
wherein the received light changing member is supported to be rotatable around an axis thereof, and includes a light-shielding portion configured to block an optical path of the sensing light of the sensor along with rotation of the received light changing member.

11. An image forming device, comprising:
a device body;
a cartridge detachably attached to the device body so as to accommodate waste material;
a plurality of sensors configured to emit and receive sensing light across the cartridge and provide detection values corresponding to an amount of the waste material in the cartridge which amount is detected based upon an intensity of the received sensing light;
a received light changing member configured to change the intensity of the sensing light received by the plurality of sensors; and
a judging unit configured to judge based upon a change of the detection values provided by the plurality of sensors whether the cartridge is new, wherein the judging unit acquires the detection value provided by each of the plurality of sensors as one of two values,
wherein the received light changing member changes intensity of the sensing light received by each of the plurality of sensors such that a detection value provided by part of the plurality of sensors is different from a detection value provided by other of the plurality of sensors,
wherein the received light changing member changes the intensity of the sensing light received by each of the plurality of sensors such that the detection values to be provided by the part of the plurality of sensors and the other of the plurality of sensors are reversed so as to be different from each other, and
wherein the judging unit judges that the cartridge is new in a case where the detection values provided by the part of the plurality of sensors and the other of the plurality of sensors are reversed so as to be different from each other.

12. An image forming device, comprising:
a device body;
a cartridge detachably attached to the device body so as to accommodate waste material;
a sensor configured to emit and receive sensing light across the cartridge and provide a detection value corresponding to an amount of the waste material in the cartridge which amount is detected based upon an intensity of the received sensing light;
a received light changing member configured to change the intensity of the sensing light received by the sensor; and
a judging unit configured to judge based upon a change of the detection value provided by the sensor whether the cartridge is new,
wherein the received light changing member is belt-shaped with a pattern formed in a longitudinal direction thereof to change the intensity of the sensing light received by the sensor, and movable in the longitudinal direction.

13. A cartridge configured to be detachably attached to an image forming device, comprising:
a chamber configured to accommodate waste material, wherein the chamber comprises a transparent portion configured such that sensing light for detecting an amount of the waste material in the chamber, which is emitted by a light emitter of the image forming device, is transmitted through the transparent portion to a light receiver of the image forming device; and
a received light changing member configured to be non-recursively moved from an initial state to a final state so as to change an intensity of the sensing light received by the light receiver by cutting across an optical path of the sensing light transmitted through the transparent portion in a non-recursive movement thereof from the initial state to the final state,
wherein the received light changing member is belt-shaped with a pattern formed in a longitudinal direction thereof to change the intensity of the sensing light received by the sensor, and movable in the longitudinal direction.

14. A cartridge configured to be detachably attached to an image forming device, comprising:
a chamber configured to accommodate material; and
a received light changing member configured to be non-recursively moved from an initial state to a final state so as to change an intensity of the sensing light and to allow an amount of the material in the chamber to be detected in a non-recursive movement thereof from the initial state to the final state,
wherein the received light changing member is belt-shaped with a pattern formed in a longitudinal direction thereof to change the intensity of the sensing light received by the sensor, and movable in the longitudinal direction.

* * * * *

UNITED STATES PATENT AND TRADEMARK OFFICE

CERTIFICATE OF CORRECTION

PATENT NO. : 7,742,708 B2
APPLICATION NO. : 12/155956
DATED : June 22, 2010
INVENTOR(S) : Yuki Fukusada It is certified that error appears in the above-identified patent and that said Letters Patent is hereby corrected as shown below:

On the Title page, Assignee (73):

Please delete "Nagoyo-shi" and insert --Nagoya-shi--

Signed and Sealed this
Eleventh Day of January, 2011

David J. Kappos

David J. Kappos
*Director of the United States Patent and Trademark Office*